US006138934A

United States Patent [19]

Helton

[11] Patent Number: 6,138,934

[45] Date of Patent: Oct. 31, 2000

[54] MULTI-ROLL SEGMENT PACKAGE FOR PLASTIC TAPE AND WINDING MACHINE FOR SAME

[75] Inventor: Kennith H. Helton, Gainesville, Ga.

[73] Assignee: Tricon Conversion, LLC, Gainesville, Ga.

[21] Appl. No.: 09/360,178

[22] Filed: Jul. 23, 1999

Related U.S. Application Data

[62] Division of application No. 09/054,667, Apr. 3, 1998, Pat. No. 6,007,016.

[51] Int. Cl.[7] ..... B65H 18/10; B65H 18/28

[52] U.S. Cl. ..... 242/160.2; 242/531.1; 242/167; 206/393

[58] Field of Search ..... 242/160.2, 160.4, 242/167, 531, 531.1, 594.3, 560; 206/393, 394

[56] References Cited

U.S. PATENT DOCUMENTS

| | | | |
|---|---|---|---|
| 2,650,703 | 9/1953 | Hagen | 206/393 |
| 4,022,396 | 5/1977 | Manchester et al. | 242/160.2 |
| 4,603,817 | 8/1986 | O'Connor | 242/160.2 |
| 4,770,366 | 9/1988 | Hood et al. | 242/560 |

FOREIGN PATENT DOCUMENTS

| | | | |
|---|---|---|---|
| 362185659 | 8/1987 | Japan | 242/160.2 |

*Primary Examiner*—John M. Jillions
*Attorney, Agent, or Firm*—Kenneth S. Watkins, Jr.

[57] ABSTRACT

A multi-roll segment package provides a method of winding a single length of plastic tape on a plurality of closely spaced roll segments. The roll segments are wound on a core with the length of tape continuous from the inner diameter of the first roll segment to the segment outer diameter of the last roll segment. Tape protectors made of a stiff web material enclose a portion of the lengths of tape between segment outer diameters to the next sequential segment inner diameter. The tape protectors stabilize the tape as it is turned or folded to the core of the next sequential roll segment position.

8 Claims, 7 Drawing Sheets

MULTI-ROLL SEGMENT PACKAGE FOR PLASTIC TAPE AND WINDING MACHINE FOR SAME

This is a divisional application of patent application No. 09/054,667, filed Apr. 3, 1998, now U.S. Pat. No. 6,007,016.

BACKGROUND OF THE INVENTION

The present invention relates to winding and, more particularly, to winding plastic tape on cores.

Plastic tape has become commonplace in a number of products including electrical products such as wire, cable, conduit, transformers and other electrical components, as well as in packaging. The use of plastic tape as ties in plastic garbage and storage bags has grown significantly. Manufacturers utilize plastic tape in the form of rolls in automated machinery to produce a wide range of these products.

Rolls of plastic tape are normally wound either on cores to aid in winding and provide improved stability of the roll. They are sometimes wound as a single "pancake" package which comprises a single roll having a width equal to the width of the plastic tape or film. Such a roll has the disadvantage of becoming unstable at large roll outer diameters, especially if the tape is narrow. The single roll package also limits the length of plastic tape, requiring frequent stopping of the machinery for roll changes.

Another winding method for roll packages utilizes a spiral or helical winding method, similar to winding a reel of line or string. This method produces a roll package with a width greater than the tape width and provides additional capacity of the roll package as compared to the "pancake" roll package. This winding method suffers the disadvantage of instability, especially near the roll package ends. Use of spools with end discs improves the stability, but increases the complexity, cost and weight of the package.

U.S. Pat. No. 4,603,817 discloses a tape package comprising a winding method which intermittently and repeatedly halts the transverse direction of the package during winding. The transverse position is maintained for at least one wrap, but fewer wraps than that which would result in a step which interferes with a spiral winding between the positions. While this method provides a greater width and higher capacity roll package as compared to a "pancake" roll package, winding density is reduced due to the spiral wrapped portions. End stability is often unsatisfactory.

OBJECTS AND SUMMARY OF THE INVENTION

Therefore and object of the present invention is to provide a roll package for plastic tape comprising multiple roll segments with no cuts or breaks in the tape from the beginning to the end of the package.

A further object of the present invention is to provide a roll package having a high wrapping density, increasing the length of tape in a given package outer diameter.

A further object of the present invention is to provide a roll package which may be wrapped to larger roll diameters, increasing the capacity of the roll package.

A further object of the present invention is to provide a roll package with improved mechanical stability, reducing the reject rate of roll packages due to damage.

The roll package of the present invention comprises a single length of plastic tape wrapped on a core in a plurality of roll segments. The tape is continuous between the beginning of the tape at the inner diameter of the first roll segment to the end at the segment outer diameter of the last roll segment. The roll segments are the approximate width of the tape.

Rotation of the core wraps the tape from the core to a segment outer diameter. At the segment outer diameter, the tape is turned from the wind direction to a transverse direction until the edge of the roll segment is reached. The tape is then turned to a radial direction along the side of the roll segment towards the core. At the core, the tape is turned to the transverse direction until the next roll segment position is reached and then turned again to the wind direction. Rotation of the core winds the next roll segment to the segment outer diameter and the process is repeated until the roll package is completed. Thus, the tape package consists of a plurality of roll segments, each pair of segments connected by a tape portion connecting the segment outer diameter of a roll segment to the inner diameter of the next sequential roll segment, the tape portion comprising at least one 90 degree turn.

A tape protector made of a sheet material may be used to aid in turning the tape from the wind direction to the transverse direction, from the transverse direction to the radial direction, from the radial direction to the transverse direction, and from the transverse direction to the wind direction. The tape protector utilizes a property of stiffness or adhesiveness to the tape to aid in the turn and stabilize the tape at the turn point. In the preferred embodiment, a tape protector of stiff paper or plastic is folded longitudinally about the tape at the segment outer diameter of a roll segment. One end of the folded protector comprises an edge of 45 degrees to the longitudinal direction of the tape protector. The 45 degree edge of the protector acts as a guide to produce a fold line or crease in the tape at substantially a 45 degree angle to the wind direction, turning the tape 90 degrees to a transverse direction. The folded protector is again folded 90 degrees at the roll segment edge adjacent to the next roll segment position, turning the tape to a radial direction towards the core. In other embodiments, adhesive tape secures a fold in the tape at the segment outer diameter, the roll segment edge, and on the core.

A machine for wrapping the roll package comprises a core drive unit and a tape positioner unit. The tape positioner unit feeds the beginning end of the tape on the core at the first roll segment position. The core drive unit rotates the core to wind the tape from the core to the segment outer diameter of each roll segment. A controller such as a programmable logic controller (PLC) monitors a wind counter or footage counter to stop the core drive unit when the roll segment reaches the segment outer diameter. The PLC then drives the tape positioner to the next roll segment position. Alternatively, the tape positioner may be positioned manually. The tape is then turned to the core at the next roll segment position and the drive restarted. Upon completion of the final roll segment, the tape is cut and secured to the package.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a multi-roll segment package of a single length tape and a method for making the package.

Figure 1:
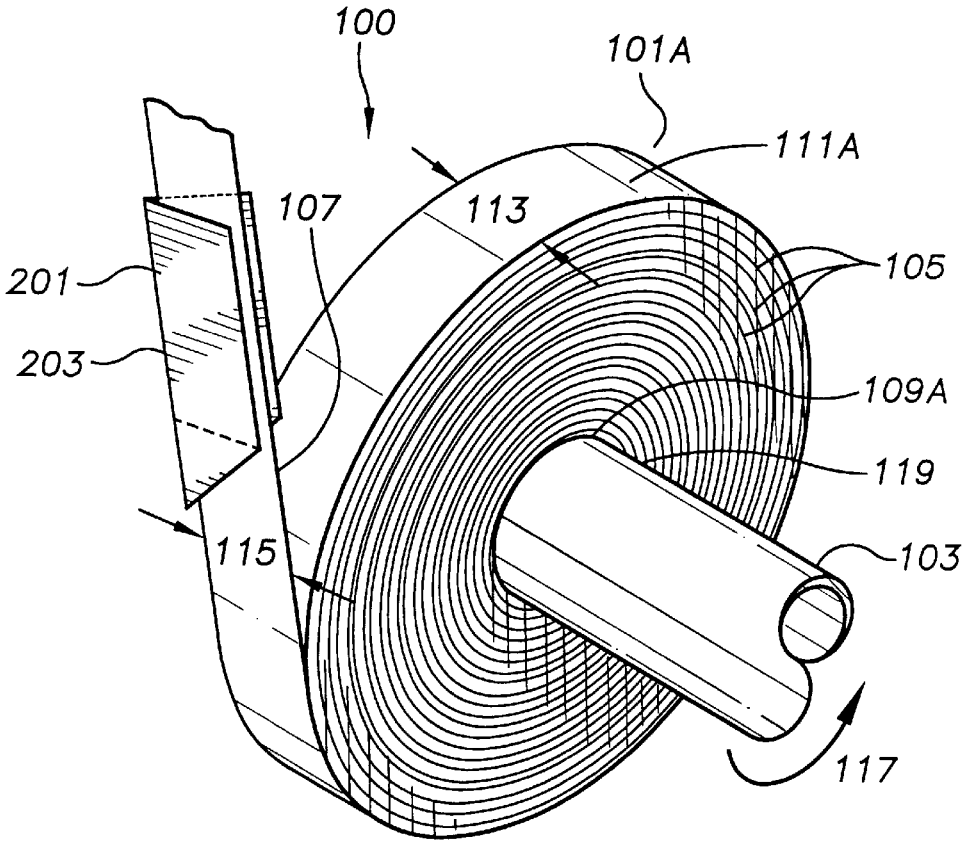
FIG. 1 is a perspective drawing of the first roll segment of a multi-roll segment package with a tape protector folded over the tape at the segment outer diameter of the roll segment.

FIG. 1 is a perspective drawing of a first roll segment 101A of roll package 100 wrapped on core 103. Roll package 100 comprises at least two roll segments of tape in the preferred embodiment. Roll segment 101A comprises a plurality of layers 105 of plastic tape 107. Roll segment 101A is wrapped in a continuous fashion from roll segment inner diameter 109A in contact with core 103 to segment outer diameter 111A. Roll segment width 113 is substantially equal to tape width 115 in the preferred embodiment. Roll segment 101A is formed by feeding the beginning (not shown) of tape 107 on driven core 103. Core 103 is rotated in the direction of arrow 117 to wind tape 107 on core 103.

In the preferred embodiment, tape 107 is a polyethylene film 0.001–0.010 inches thick, and more preferably 0.002–0.006 inches thick. Tape width 115 is 0.25–6.0 inches, and more preferably, 0.5–3.0 inches wide. In other embodiments, other polymer films of varying thickness and widths may be used. Core 103 may be metal, plastic or fiber. In the preferred embodiment, core 103 is fiberboard. Core diameter in the preferred embodiments is 1.0–8.0 inches in diameter, and more preferably 2.0–6.0 inches in diameter. Core length depends on the number of roll segments wound on core 103. In the preferred embodiment, core 103 length is 2.0–36.0 inches long, and more preferable 8.0–24.0 inches long.

Figure 2:
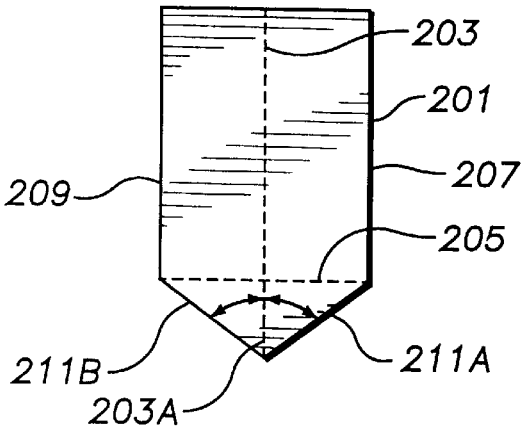
FIG. 2 is a plan view of the tape protector of FIG. 1 showing the fold guide edges and longitudinal and transverse fold lines of the protector.

FIG. 2 shows a plan view of tape protector 201 used to protect and turn tape 107 of FIG. 1 to wrap additional roll segments on core 103. Protector 201 is made of a sheet material such as paper, paperboard, or plastic. In the preferred embodiment, protector 201 is made of a material of higher stiffness than the plastic tape, such as stiff paper. Protector 201 is foldable along longitudinal fold line 203 and transverse fold line 205. Edges 207 and 209 are parallel to longitudinal fold line 203 and are located approximately tape width 115 distance from longitudinal fold line 203. In the preferred embodiment, fold guide edges 211A and 211B form a 45 degree angle with longitudinal fold line 203. In the preferred embodiment, the length of protector 201 along fold line 203 is 1.0–12.0 inches, and more preferably, 4.0–8.0 inches.

Figure 3:
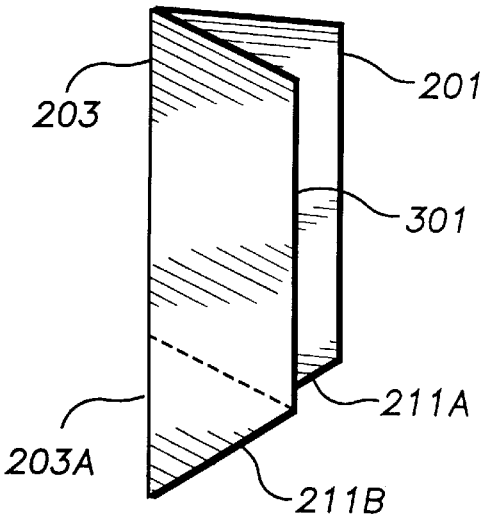
FIG. 3 is a perspective drawing of the tape protector of FIG. 2 folded along the longitudinal fold line.

FIG. 3 is a perspective drawing of protector 201 folded along longitudinal fold line 203 and ready to accept tape 107 in opening 301. FIG. 1 shows protector 201 inserted over tape 107 in the orientation preferred when a second segment is to be wound on the next sequential position 119 of core 103. Fold line 203 of protector 201 is placed opposite of next sequential position 119 and fold guide edges are orientated towards roll segment 101A. Fold line 203A of FIG. 2 is the portion of fold line 203 between guide edges 211A and 211B and transverse fold line 205.

Figure 4:
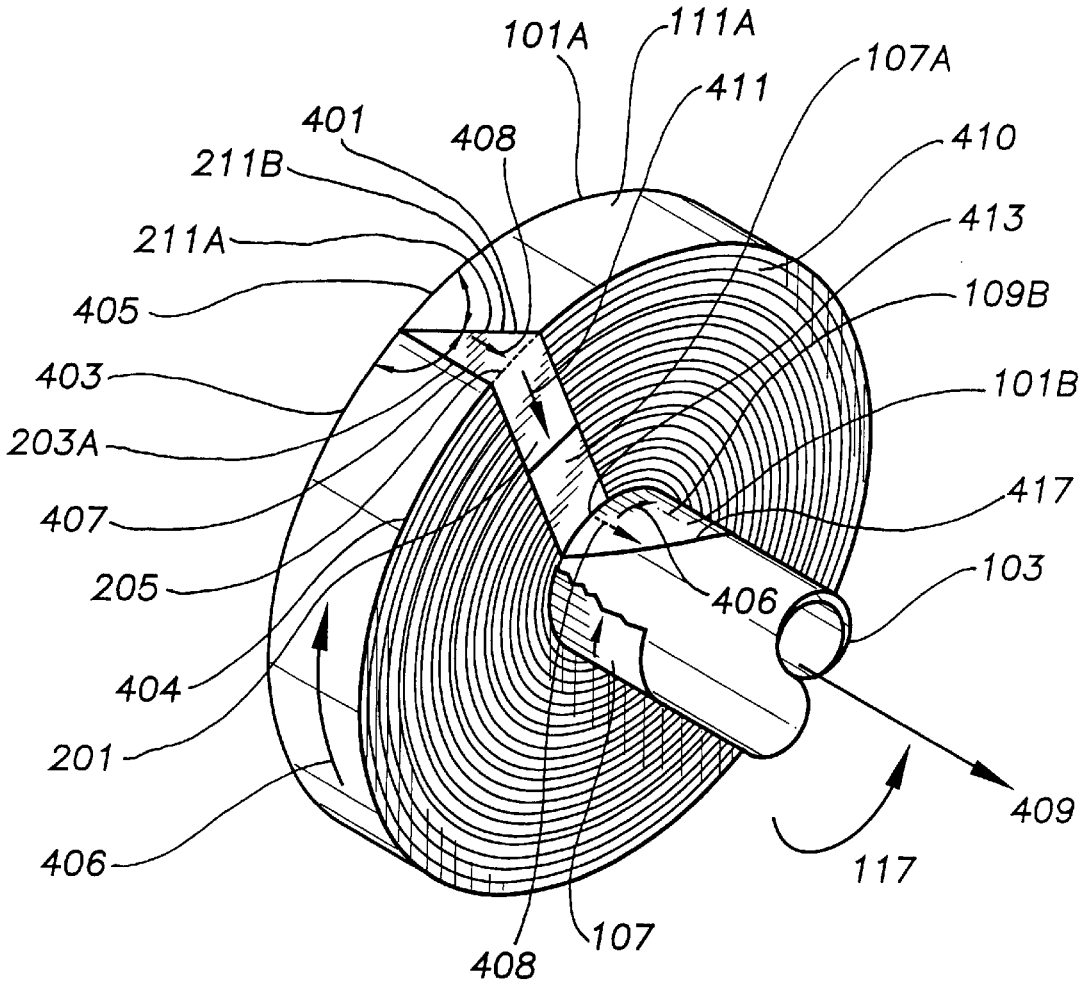
FIG. 4 is a perspective drawing showing the plastic tape routed from the segment outer diameter of a first roll segment to the core at a second roll segment position utilizing a tape protector.

FIG. 4 is a perspective drawing of protector 201 encompassing some of portion 107A of tape 107 and acting as a guide to perform the folds leading from the outer diameter of roll segment 101A to the beginning or inner diameter 109B of a second roll segment 101B. Tape portion 107A is the portion of tape connecting outer diameter 111A of segment 101A to inner diameter 109B of roll segment 101B. Tape portion 107A is folded along fold guide edges 211A and 211B, resulting in a tape fold line 401 at an angle of 135 degrees with tape edge 403, and 45 degrees with roll segment edge 405, and 45 degrees with protector fold line portion 203A.

In the preferred embodiment, fold line 401 is a sharp crease formed in tape portion 107A. Fold line 401 results in turning tape portion 107A ninety degrees from wind direction 406 to transverse direction 408. Transverse direction 408 is parallel to the rotational axis 409 of core 103 and towards the next roll segment 1011B. Bottom edge 407 of tape portion 107A inside protector 201 forms a 90 degree angle with tape edge 403 and roll segment edge 404. Protector 201 makes a second fold along transverse fold line 205 at roll segment 101A edge 404 to turn tape portion 107A and protector 201 ninety degrees from transverse direction 408 to radial direction 411 along side 410 of roll segment 101A. Radial direction 411 is perpendicular to core rotational axis 409 and towards core 103. Where tape portion 107A contacts core 103, third fold line 413 turns tape portion 107A ninety degrees from radial direction 411 to transverse direction 408 along core 103. Fourth fold line 417 turns tape portion 107A ninety degrees back to wind direction 406. Fold line 417 forms a 45 degree angle with transverse direction 408. In the preferred embodiment, fold line 417 is a sharp crease in tape portion 107A. The first wrap of tape 107 around the new core position 101B secures tape portion 107A to core 103. Although tape 107 continues wrapping roll segment101B, the continuing portion is removed for clarity in the drawing.

In other embodiments, tape protector 201 length may be extended to encompass the full length of tape portion 107A between the segment outer diameter of segment 101A to the inner diameter of segment 101B. In still other embodiments, two protectors may be employed, one at the segment outer diameter and a second (not shown) at the segment inner diameter.

Figure 5:
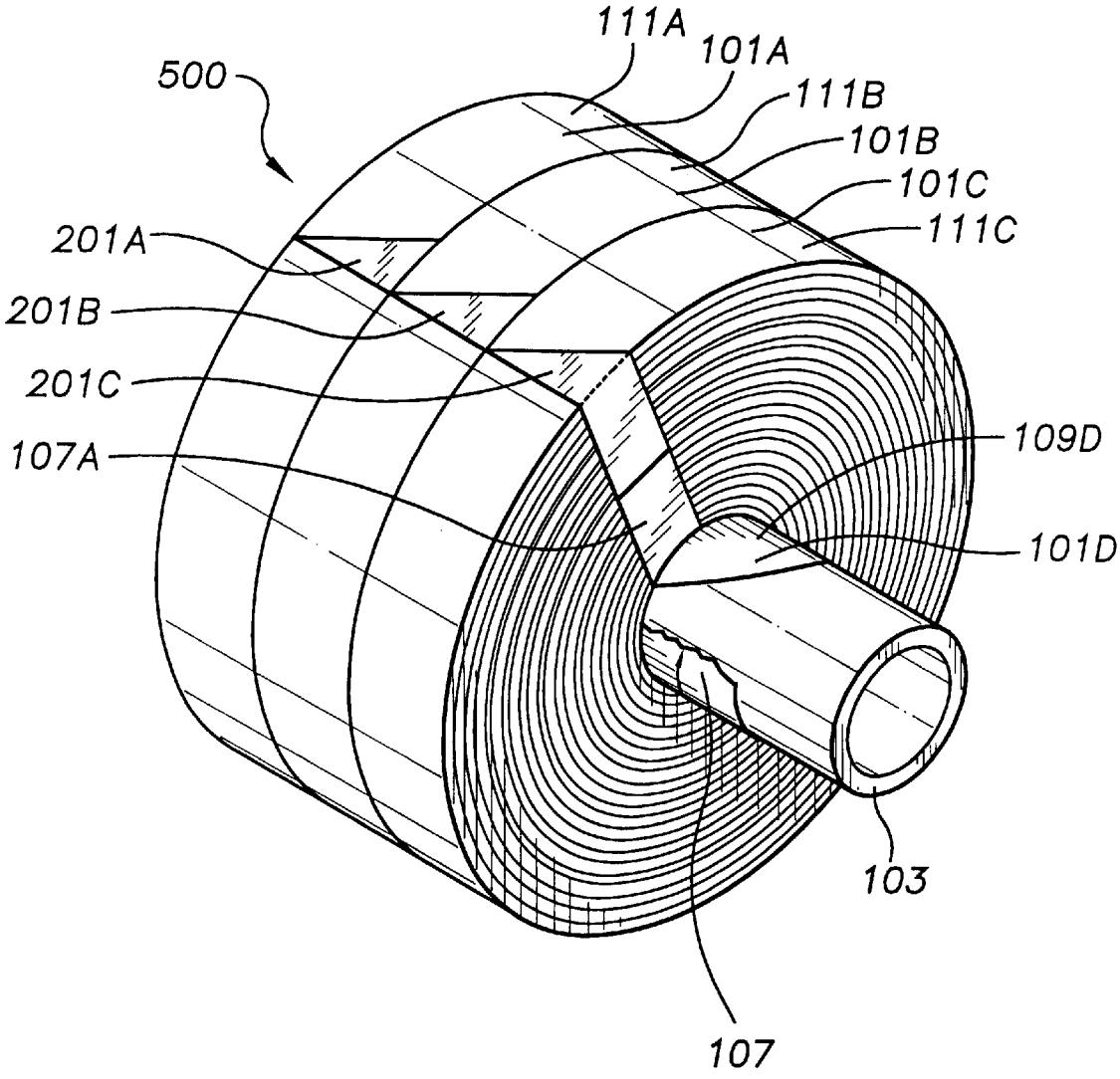
FIG. 5 is a perspective drawing showing three completed roll segments of the multi-roll segment package and the beginning of a fourth roll segment of the package.

FIG. 5 is a perspective drawing of embodiment 500 of a multi-roll segment package showing three roll segments 101A, 101B, and 101C wound on core 103. The fold guide ends of tape protectors 201A, 201B and 201C are shown on the respective segment outer diameters 111A, 111B and 111C of the roll segments. Protector 201C aids in turning and routing tape portion 107A to core 103 where the inner diameter 109D of roll segment 101D has been started on core 103. The continuation of tape 107 on roll segment 101D is removed for clarity in the drawing.

Figure 6:
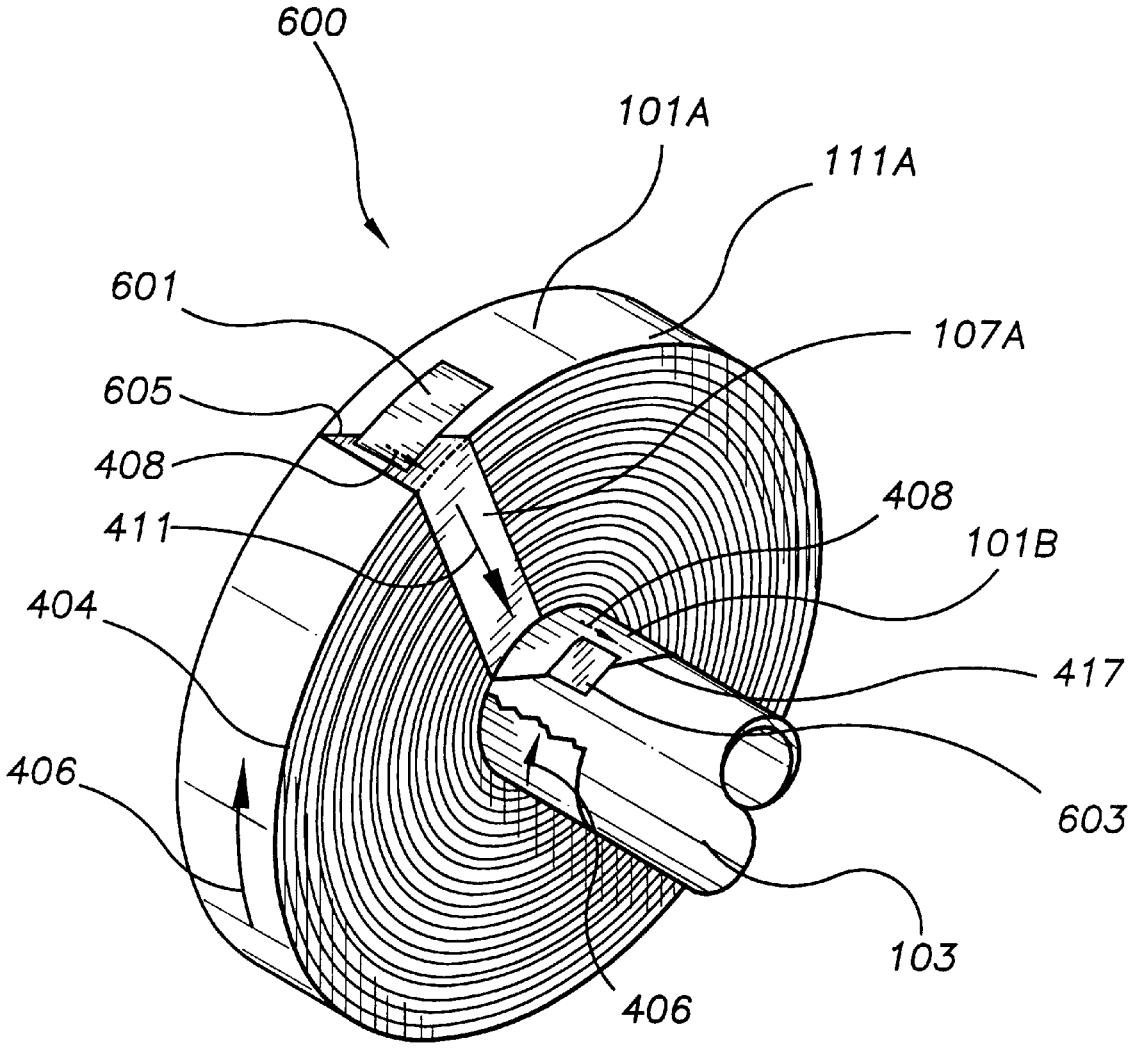
FIG. 6 is a perspective drawing of an alternative embodiment of the multi-roll segment package utilizing an adhesive strip to secure tape folds at the segment outer diameter and at the core of the tape package.

FIG. 6 is a perspective drawing of embodiment 600 of a multi-roll segment package showing roll segments 101A and 101B being wound on core 103. In this embodiment, adhesive tape or strip 601 is used to secure fold 605 of tape portion 107A against segment outer diameter 111A of roll segment 101A. Adhesive strip 601 aids in turning tape portion 107A 90 degrees from wind direction 406 to transverse direction 408.

Tape portion 107A is bent or folded 90 degrees along edge 404 of roll segment 101A in a radial direction 411 towards core 103. At core 103, tape portion 107A is folded to turn tape portion 107A 90 degrees back to transverse direction 408. A fold 417 made 45 degrees to transverse direction 408 on core 103 turns tape portion 107A 90 degrees back to wind direction 406. A second adhesive strip 603 secures fold 417 to core 103.

If tape 107 is adequately stiff and has sufficient surface friction against itself and core 103, the use of protectors and adhesive strips can be eliminated. In this case, the tape characteristics of stiffness and surface friction provide the securing means for turning the tape as shown in the figures.

Figure 7:
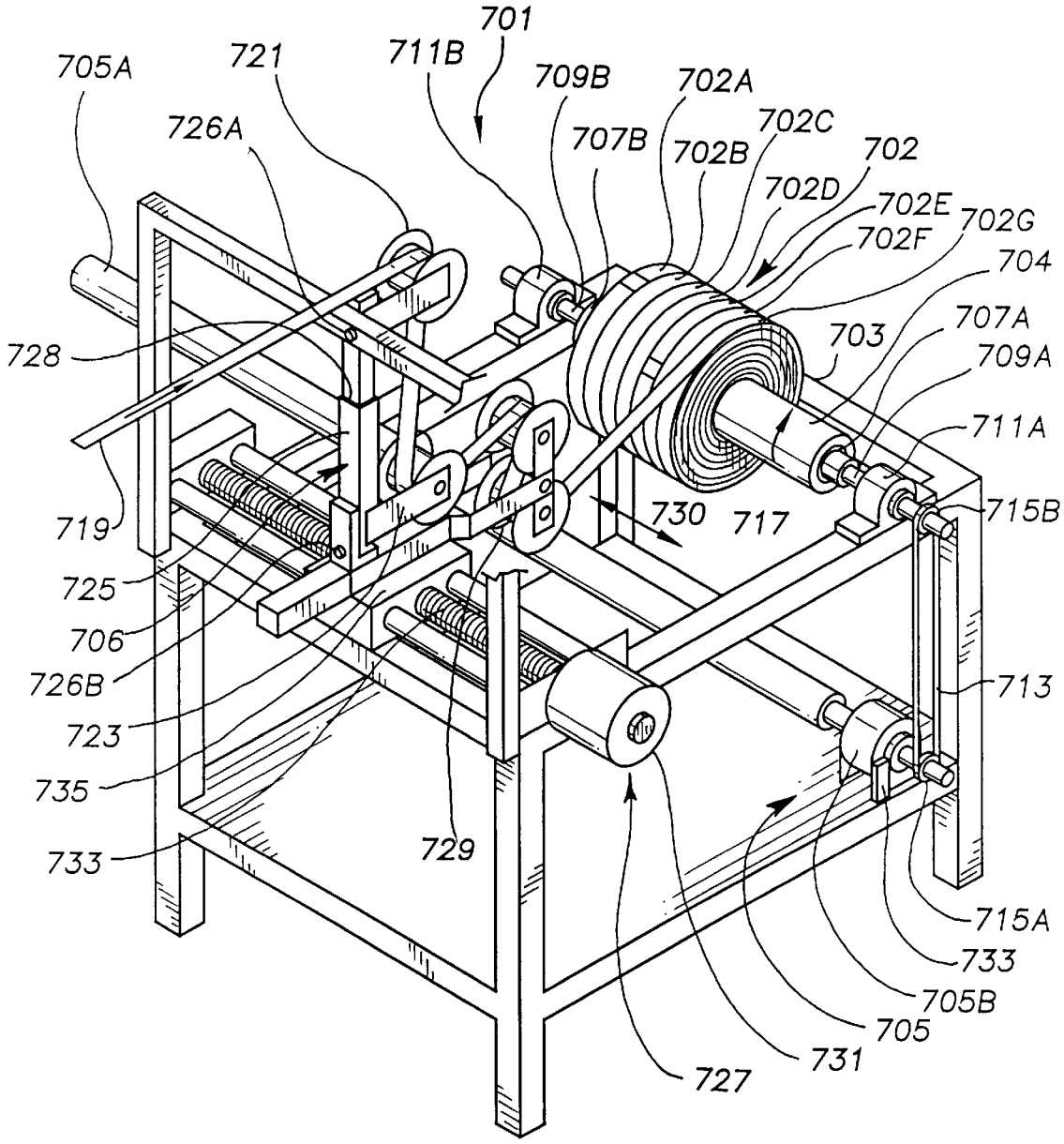
FIG. 7 is a perspective drawing of a wind machine for a multi-roll segment package showing the tape positioning unit, core drive unit, and framing, with a partially completed multi-roll tape package on the driven core.

FIG. 7 is a perspective drawing of a winding machine 701 for plastic tape or ribbon on multi-roll segment package 702. In the preferred embodiment, machine 701 comprises a frame 703 supporting a package core 704, drive unit 705, and tape feed unit 706. Chucks 707A and 707B support core 704 by way of rotating shafts 709A and 709B and bearing assemblies 711A and 711B. Bearing assemblies 711A and 711B are attached to frame 703 by fasteners (not shown). Drive unit 705 comprises a motor (not shown) and rotates core 704 via drive shaft 705A, clutch 705B, drive belt 713, pulleys 715A and 715B, and shaft 709A.

Rotation of core 704 in the direction 717 feeds plastic tape 719 onto core 704. Clutch 705B such as a magnetic particle clutch provides fine control of the tension of tape 719 as it is wound on core 704. An unwind drive and tension measuring device such as a dancer roll (not shown), located between an unwind stand and wind machine 701, controls clutch 705B.

Tape feed unit 706 comprises tape receiving guide 721, transverse guide 723, telescoping pivot arm 725, transverse positioner 727, and tension/feed guide 729. In the preferred embodiment, transverse positioner 727 is a linear positioner comprising a stepper motor 731, lead screw 733 and follower unit or linear slide 735. A control unit (not shown) provides pulses to stepper motor 731 to position linear slide 735 to the desired transverse position 730.

Transverse guide 723 and tension/feed guide 729, attached to linear slide 735, feed tape 719 to the desired roll segment position on core 704. Telescoping pivot arm 725 pivots tape receiving guide 721 at pivot 726A and transverse guide 723 at pivot 726B in the direction of transverse movement of linear slide 735. The pivoting motion of guides 721 and 723 improve tape stability, especially at high speeds. Telescoping pivot arm 725 telescopes at 728 to compensate for the length of arm 725 as linear slide 723 traverses in direction 730. In this way, pivot arm 725 acts as a compensation unit, aligning the tape receiving guide 721 to the transverse guide 723 as linear slide 735 and tension/feed guide 739 are positioned to different transverse positions along core 704.

In other embodiments, pivot arm 725 pivots either receiving guide 721 or transverse guide 723 as guide 729 is repositioned. In still other embodiments, separate drive mechanisms (not shown) are used to rotate or otherwise reposition guides 721 and 723 as tension/feed guide 729 is traversed along roll segment positions 702A–702G.

In the preferred mode of operation, a slitter (not shown) slits and feeds tape 719 to tape receiving guide 721. Transverse positioner 727 positions tensioner/feed guide 729 transversely as shown in direction 730 to the desired transverse position of core 704. The beginning of tape 719 (not shown) is attached to position 702A of core 704 by an adhesive strip or by subsequent wound layers. Roll segments 702A–702G are sequentially wound about core 704 as described in the earlier figures. As each roll segment reaches its segment outer diameter, core 704 is stopped and tape 719 is turned to core 704 at the next core position corresponding to the sequential roll segment.

Transverse positioner 727 is sequenced to the next position to guide and feed tape 719 to the new roll segment position. Upon completion of the last roll segment of multi-roll segment package 702, tape 719 is cut and fixed to the roll package by adhesive strips, tying, or other attachment means.

In an alternative embodiment, tape 719 is positioned to the desired roll segment position on core 704 by a core positioner (not shown). The core positioner shifts core 704 in transverse direction 730 to align tape tensioner/feed guide 729 to the desired roll segment position.

Figure 8:
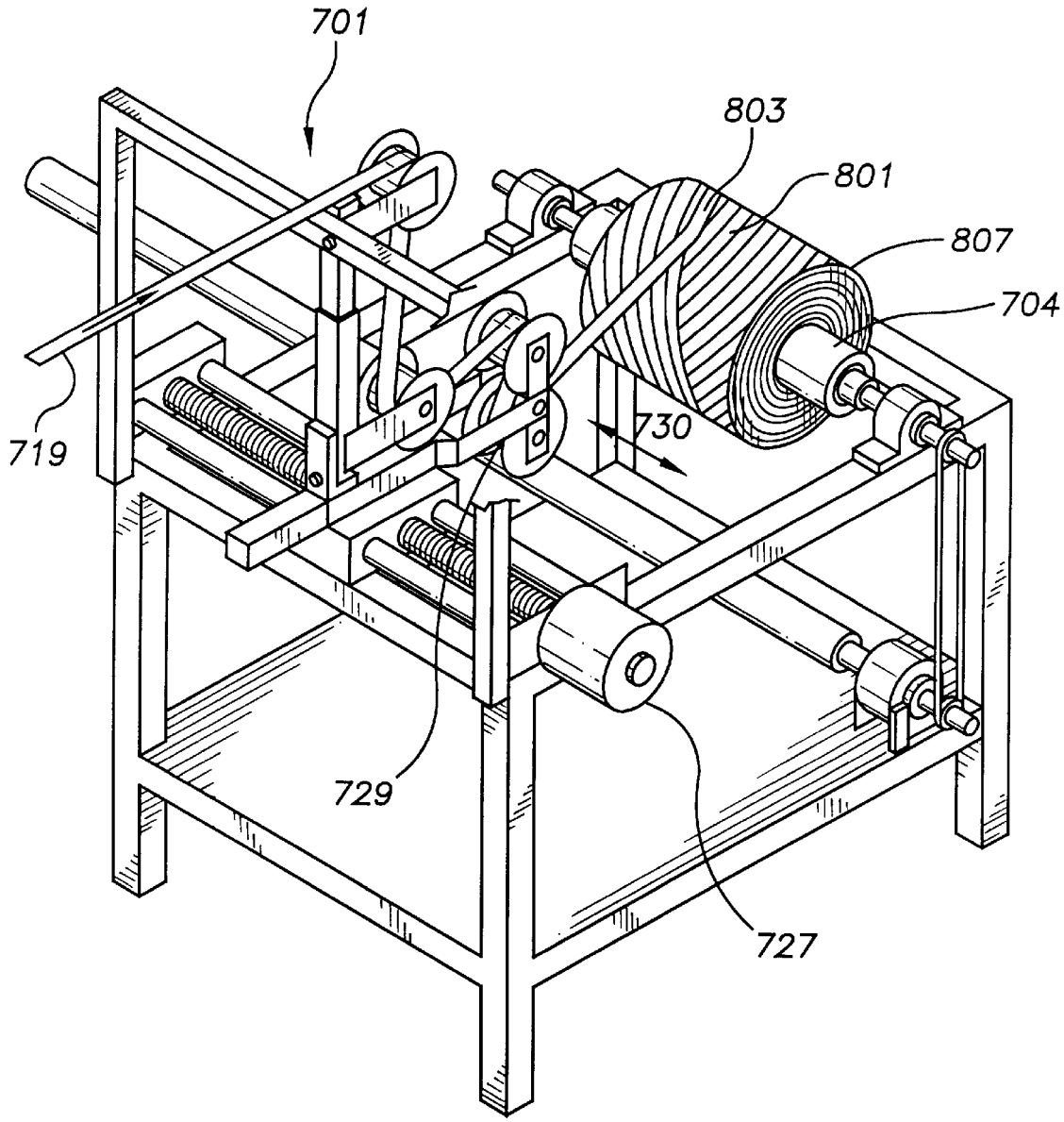
FIG. 8 is a perspective drawing of the wind machine for a multi-roll segment package with a completed multi-roll tape package with helically wrapped cover.

FIG. 8 is a perspective drawing of winding machine 701 with a multi-roll segment package 801. Package 801 comprises a plurality of roll segments similar to 702A–702G of FIG. 7. Helically wrapped tape 803 is wrapped over the segment outer diameter of the roll segments by one or more layers of as shown in the figure. Transverse positioner 727 drives tensioner/feed guide 729 continuously in a back and forth in transverse motion 730 as core 704 is rotated to produce the helical tape layer 807. Layer 807 provides stability and a protective cover for the roll segments.

Figure 9:
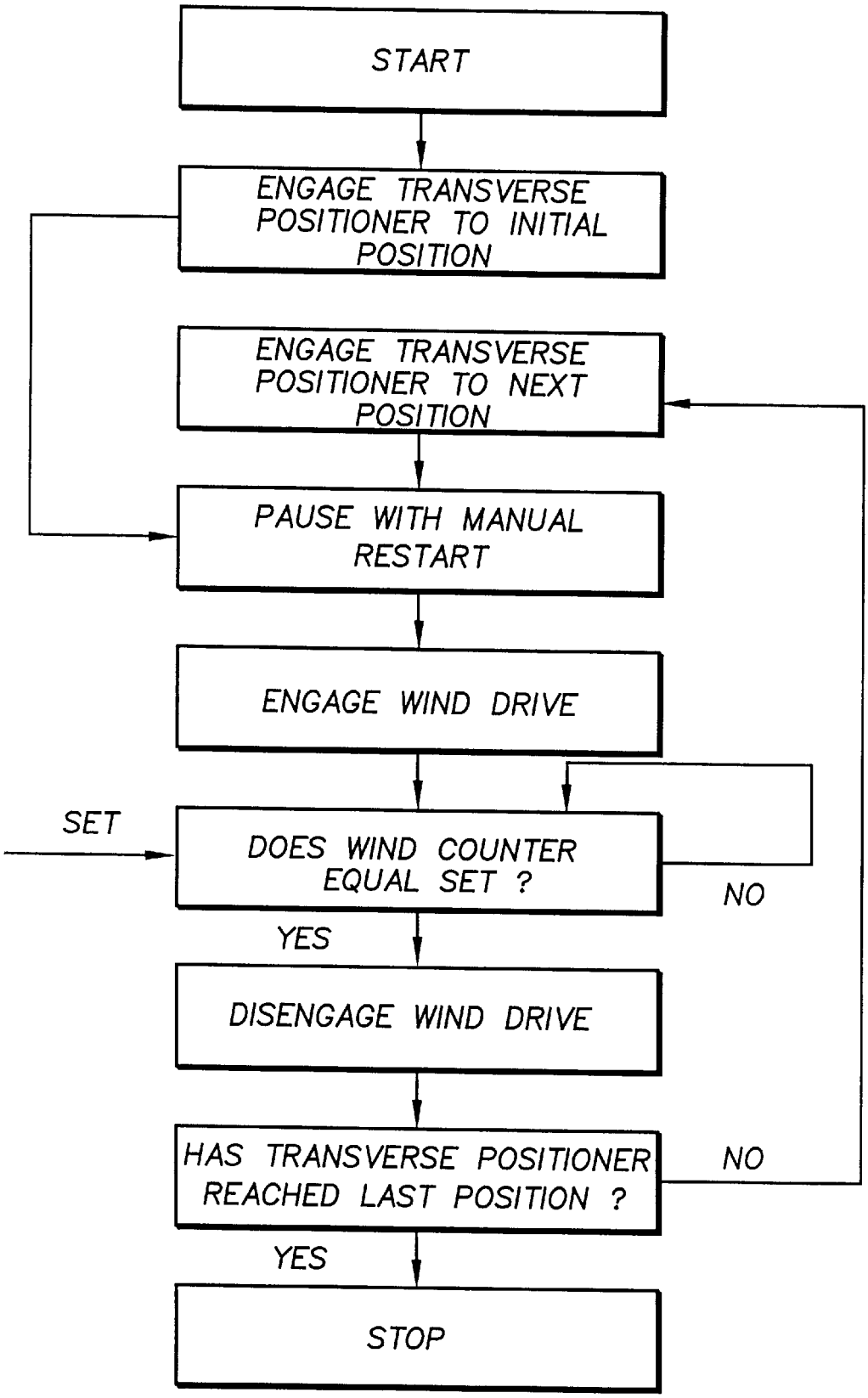
FIG. 9 is a flow chart of a controller of a winding machine used to wrap a single length of plastic tape on a multi-roll segment package.

FIG. 9 is a flow chart for the control system for the winding machine of FIG. 7. At the start of the wind operation, the control system which may comprise a programmable logic controller (PLC) commands stepper motor 731 to position transverse positioner 727 to the initial or start position. This position lines up tensioner/feed guide 729 to position 702A at one end of core 704. Tape 719 is fed through the machine and secured to core 704, for example with an adhesive strip. A timed or manual restart of the sequence starts drive 705, beginning wrapping of roll segment 702A.

Wind counter 733 provides a wind count to the PLC. Alternatively, wind counter 733 may be replaced by a linear footage counter (not shown) in the tape feed path. The PLC stops or disengages drive 705 when the wind counter reaches a setpoint representing the segment outer diameter of roll segment 702A. The PLC commands transverse positioner 727 to position the tensioner/feed guide to the next roll segment position (702B) and pauses, allowing the operator to route the tape to core 704 as previously explained. Upon manual or timed restart, wind drive 705 is re-engaged to wrap the second roll segment 702B. This process is repeated until the final roll segment is completed, upon which the PLC stops the roll segment winding process. Optionally, a cover wrapping of stepped spiral, or helical winding is made over the roll segments after completion of the roll segments.

Accordingly the reader will see that the MULTI-ROLL SEGMENT PACKAGE FOR PLASTIC TAPE AND WINDING MACHINE FOR SAME disclosed and claimed provides an improved roll package for plastic tape and a machine capable of winding a multi-roll segment package. The roll package provides the following additional advantages:

The roll package is high density, increasing the length of tape on a given size roll package, reducing converting roll change time and shipping costs;

The roll package is stable, reducing roll package damage and waste;

Larger package diameters may be wound, reducing converting equipment change time and shipping costs; and The roll package is simple to make and use.

Although the description above contains many specifications, these should not be construed as limiting the scope of the invention but as merely providing illustrations of some of the presently preferred embodiments of this invention. For example, tape of other materials such as paper, fabric, non-wovens, metal foil, composites or laminates may be wound using this process. The tape may be folded longitudinally before wrapping, or, the tape may comprise a tube of film material. The tape turn magnitudes may be varied from 90 degrees or the protector fold guide edges varied from 45 degrees to reach different areas on the core. Thus the scope of the invention should be determined by the appended claims and their legal equivalents, rather than by the examples given.

I claim:

1. A multi-roll segment package for tape, the package comprising:

a roll core;

at least two roll segments, each of said at least two roll segments comprising tape of predetermined width wrapped about the core and having a width substantially equal to the predetermined width of the tape and extending from an inner diameter at the core to a segment outer diameter;

a first fold comprising a crease and turning the tape substantially 90 degrees at the segment outer diameter of a first of said at least two roll segments, the first fold routing the tape to the inner diameter of a second of at least two roll segments;

the tape being continuous from the inner diameter of the first of said at least two roll segments to the outer diameter of the second of said at least two roll segments.

2. The multi-roll package of claim 1 wherein the first fold turns the tape from a wind direction to a transverse direction parallel to a rotational axis of the core and towards the second of at least two roll segments, and a second fold of substantially ninety degrees disposed on a first edge of the first of at least two roll segments which turns the tape from the transverse direction to a radial direction towards the core.

3. The multi-roll package of claim 2 comprising a third fold of substantially 90 degrees disposed on the core which turns the tape from the radial direction to the transverse direction and along the core.

4. The multi-roll package of claim 3 comprising a fourth fold of substantially 90 degrees which turns the tape from the transverse direction and along the core to the wind direction on the second of at least two roll segments.

5. A multi-roll segment package of tape, the package comprising:

a roll core comprising a roll axis;

at least two roll segments, each of said at least two roll segments tape of predetermined width wrapped about the core, each of said at least two roll segments having a width substantially equal to the predetermined width of the tape and extending from an inner diameter at the core to a segment outer diameter;

said at least two roll segments being adjacent and connected by a first length of the tape extending from the segment outer diameter of a first of said at least two roll segments in a radial direction along a side of the first of said at least two roll segments to the inner diameter of a second of said at least two roll segments, the first length of tape supported by a restraint means for restraining the first length on the segment outer diameter of the first of said at least two roll segments and wherein the first length comprises a radial distance of at least 10 layers of the tape.

6. The multi-roll package of claim 5 wherein the restraint means comprises a tape protector, the tape protector made of a stiff sheet material and cooperating with a first portion of the first length of tape when folded around the first portion to restrain the first portion of the first length on the segment outer diameter of the first of said at least two roll segments.

7. The multi-roll package of claim 5 wherein the restraint means comprises an adhesive strip applied to a first portion of the first length of tape on the segment outer diameter of the first of said at least two roll segments.

8. A process for winding a single length of tape on a core to form a multi-roll segment package, the process comprising the steps of:

securing a first end of the tape to a first position on the core;

winding a first roll segment at the first position on the core to a segment outer diameter, the first roll segment comprising at least 10 layers of tape;

securing a creased fold in a first length of the tape on the segment outer diameter of the first roll segment;

turning and securing the tape to a second position on the core; and winding a second roll segment on the core.

* * * * *